United States Patent [19]

Hall et al.

[11] 4,384,185

[45] May 17, 1983

[54] CIRCUIT INTERRUPTING DEVICE

[75] Inventors: Walter J. Hall, Evanston; John M. Jarosz, Skokie, both of Ill.

[73] Assignee: S&C Electric Company, Chicago, Ill.

[21] Appl. No.: 235,333

[22] Filed: Feb. 17, 1981

[51] Int. Cl.[3] ..... H01H 33/70

[52] U.S. Cl. ..... 200/148 R; 200/61.08; 200/148 F

[58] Field of Search ..... 200/148 R, 148 F, 148 G, 200/148 A, 148 B, 148 C, 148 D, 148 E, 148 H, 148 J, 148 BV, 61.08

[56] References Cited

FOREIGN PATENT DOCUMENTS 255586 5/1963 Australia ..... 200/148 B

*Primary Examiner*—A. T. Grimley

*Assistant Examiner*—Morris Ginsburg

*Attorney, Agent, or Firm*—John D. Kaufmann

[57] ABSTRACT

A high-voltage circuit-interrupting device includes a replaceable container of pressurized arc-extinguishing fluid. A fluid port of the container is closed by a puncturable seal. When an overcurrent occurs in the circuit, the seal is punctured before interrupting contacts of the device open so that the fluid is already flowing when an arc forms between the contacts. Overcurrents are sensed by either a fusible element or a current transformer. Fluid flow before contact opening is achieved by mechanical facilities responsive to the melting of the fusible element or the output of the transformer. The entire device—including the container, the overcurrent sensor and the mechanical facilities—is at the voltage of the circuit.

21 Claims, 8 Drawing Figures

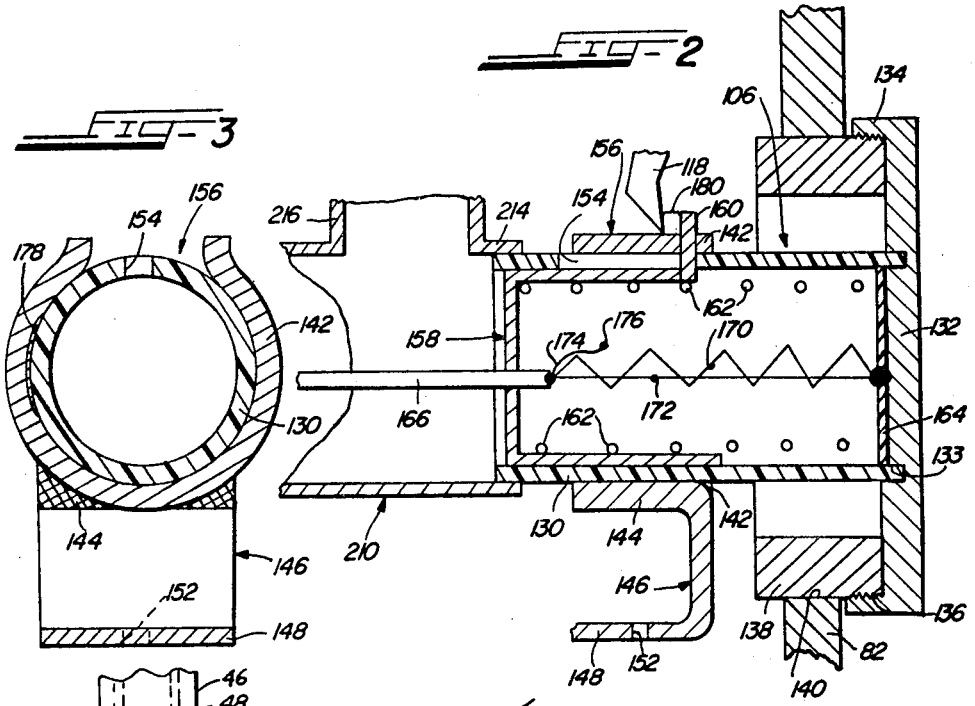
FIG-2
FIG-3
106
134
156
118
180
160
142
154
216
214
178
158
174
176
170
132
166
172
162
164
130
133
144
146
210
152
148
138
136
82
140
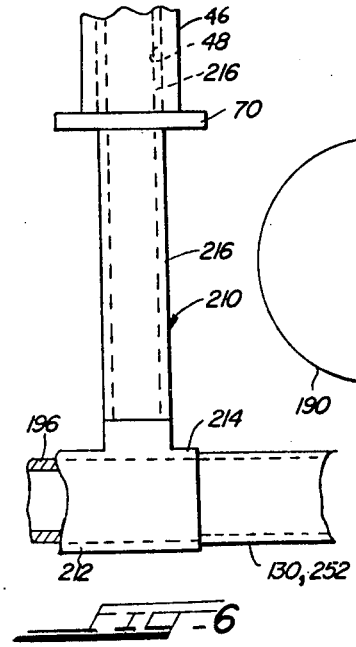
46
48
216
70
210
196
214
212
130,252
FIG-6
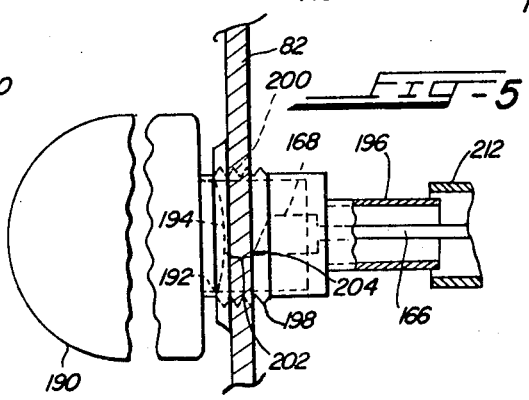
82
200
FIG-5
168
196
212
194
192
204
198
166
202
190
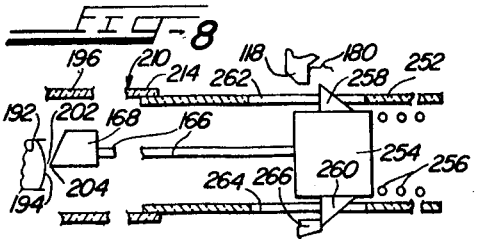
FIG-8
196
210
214
118
180
262
258
252
192
202
168
166
254
256
260
264
266
204
194

CIRCUIT INTERRUPTING DEVICE

BACKGROUND OF THE INVENTION

1. Field of the Invention

This invention relates to an improved circuit interrupting device, and, more specifically, relates to a simple, inexpensive circuit interrupting device which is bus-mountable and manually resettable and which is simple in construction and reliable in operation.

2. Prior Art

Various types of circuit interrupting devices—including fuses or fuse-like devices, circuit breakers, reclosers, and Circuit Switchers—are well known for circuit protection. These devices have varying operational characteristics and features which make their use attractive in some environments, but less attractive in other environments. In the past, operational features tended to be the sole criterion determining which type of device was to be used. Today, however, the cost of the devices is becoming an important, if not the most important, determinant relative to deciding which device shall be used in a particular environment. Users of circuit interrupting devices are often willing to forego purchasing expensive, exotic, full-range interrupting capability devices and to purchase less expensive, simpler devices, even though the latter may have more limited interrupting capabilities.

One use environment in which users today may employ less expensive, simpler devices is transformer protection. Devices which up to now have been employed for transformer protection have been either complicated or expensive or both. Economic conditions have forced equipment users, especially utilities, to consider employing transformer protective devices which are not full range and are less versatile or sophisticated, but which are, at the same time, substantially less expensive. Specifically, many utilities have come to realize that there are times when it is expeditious to use an inexpensive interrupting device having a more limited interrupting rating as opposed to a full-range interrupting device, if the inexpensive device is sufficiently less expensive than alternative full-range devices so as to make the use of the former attractive from a capital investment standpoint.

Most prior art interrupting devices include various types of "intelligence" and sensors. The intelligence processes information provided by the sensors, which information relates to the current in an electrical circuit. The intelligence dictates the operation or lack of operation of the device based on such information. Various sensing and intelligence schemes are well known; some are simple, while others are quite complex. One common characteristic of most present-day transformer protective devices is the location of the sensing and/or intelligence at ground potential rather than at line potential. This location, of course, necessitates electrical insulation and isolation between the sensing and intelligence, on the one hand, and the device at line potential, on the other hand. This requirement for isolation in turn leads to the use of complex mechanical and electrical schemes for interconnecting the sensing and the intelligence, which are at ground potential, to the circuit interrupting device, which is at line potential.

Accordingly, it is desirable to provide a simple, reliable, inexpensive interrupting device having a limited interrupting rating, but which nevertheless is attractive in view of its low cost. It is also desirable to provide a device which is completely bus- or line-mountable and which operates at bus or line voltage. Such a device is even more attractive should its entire sensing and intelligence also be at line or bus potential, thus obviating the need for complex interconnections between the interrupting device and the intelligence and sensing. From a cost standpoint, it would also be desirable to have such a device manually resettable from the ground level which, accordingly, obviates the necessity of an expensive and complicated reclosing mechanism. Toward these ends, the present invention is aimed.

SUMMARY OF THE INVENTION

With these and other objects in view, the present invention relates to an improved circuit interrupting device. The improvement is applied to known types of interrupting devices which, in general, have an insulative housing containing a pair of normally engaged contacts. The contacts are relatively movable for disengagement to interrupt the circuit. The circuit interrupting device also includes facilities for biasing the contacts toward disengagement. A dielectric fluid directed at an elongating arc formed in a gap opened between the relatively moving, disengaged contacts is effective to extinguish the arc.

In its broadest aspects, the improvement of the present invention contemplates a two-position lever facility which moves between a first normal and a second position. In the first position, the lever facility maintains the contacts engaged against the action of the biasing facility and, in its second position, permits relative movement of the contacts by the biasing facility. Also included is a container of pressurized dielectric fluid which has a port through which the fluid issues and a puncturable seal facility which normally closes the port. Facilities direct the fluid from the port to the gap. Lastly, facilities responsive to an overcurrent through the device first puncture the seal facility and then move the lever facility to its second position. As a consequence, the contacts are disengaged in an environment of already flowing dielectric fluid which ensures extinguishment of the arc and circuit interruption.

There are two embodiments of the present invention. In the first embodiment, the overcurrent responsive facilities include a fusible element through which passes the current through the device. The fusible element ceases to be intact when an overcurrent of a predetermined magnitude flows therethrough. In the second embodiment, the overcurrent responsive facilities include a current transformer which produces an output proportional to the current through the device. In both embodiments, the overcurrent responsive facility is at line potential.

In both embodiments, the overcurrent responsive facilities include a carriage movable between a first and a second location. The carriage carries a lance for puncturing the seal facility after a predetermined amount of movement of the carriage out of its first location. A finger on the carriage moves the lever means from the first to its second position after movement of the carriage in excess of the predetermined amount. In both preferred embodiments, a biasing mechanism biases the two-position lever into its first position while another biasing mechanism biases the carriage for movement out of its first location toward the second location. In the first embodiment, the fusible element normally prevents carriage movement when the fusible element is intact. In the second embodiment, carriage movement is prevented by a latch which is selectively operable to permit carriage movement in response to the electrical output of facilities which process signals provided thereto by the current transformer.

Preferably, in both embodiments the fluid container and its port and seal facility are removably mounted to the device so that following operation of the device, the gas container and its associated elements may be replaced to recondition the device for further operation. In the first embodiment, it is also preferred that the fusible element, the carriage, and the lance form a single module which is replaceable following operation of the device.

BRIEF DESCRIPTION OF THE DRAWING

FIGS. 2–6 are magnified views of various portions of the circuit interrupting device of FIG. 1 showing in greater detail their constructional and operational features;

FIG. 8 is a magnified view of a portion of the device of FIG. 7.

DETAILED DESCRIPTION

General

Figure 1:
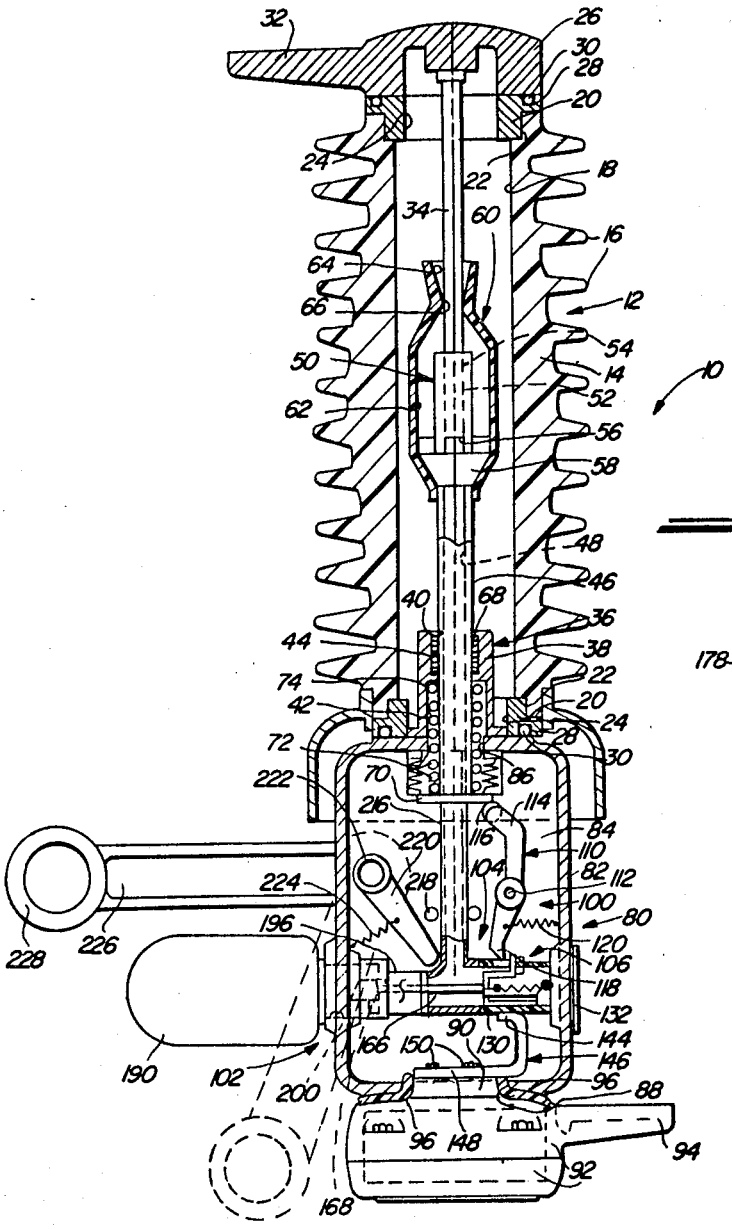
FIG. 1 is a front, partially sectioned, elevational view of one embodiment of a circuit interrupting device according to the principles of the present invention.
Figure 7:
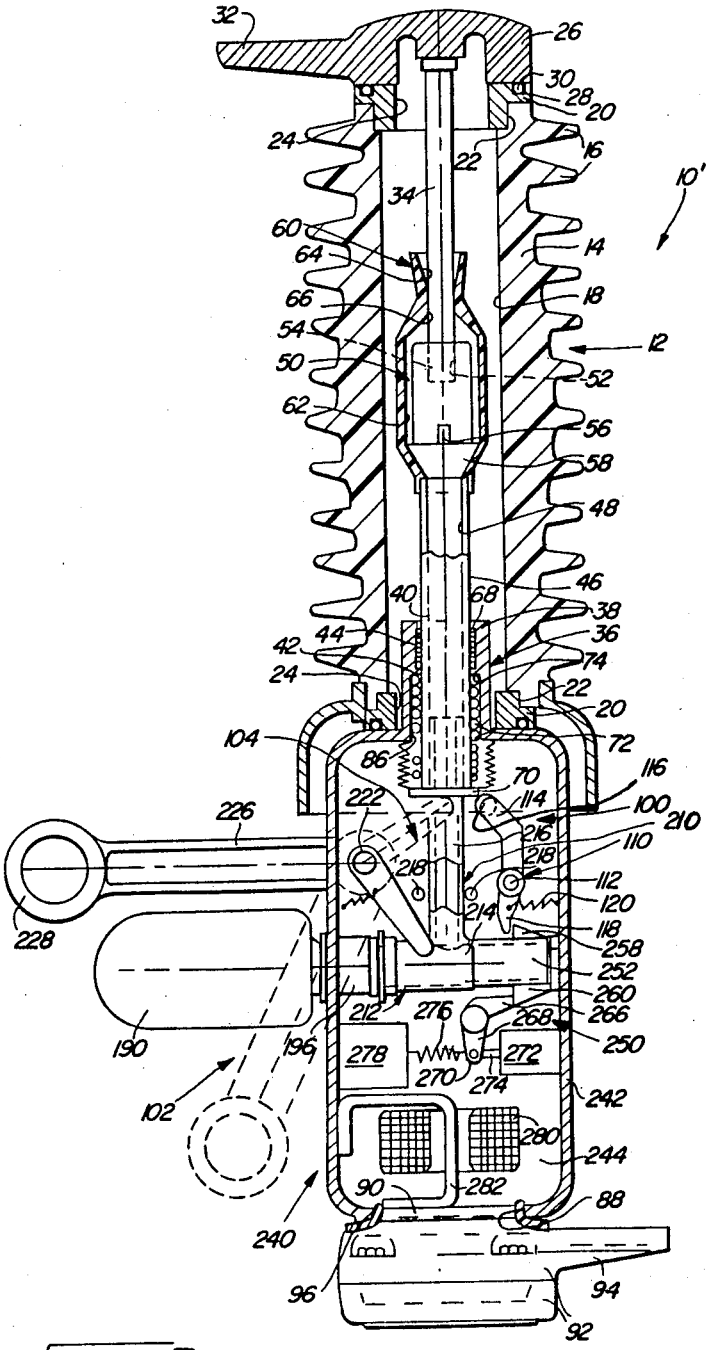
FIG. 7 depicts a front, elevational, partially sectioned view of another embodiment of a circuit interrupting device in accordance with the principles of the present invention.

FIGS. 1 and 7, respectively, depict alternate embodiments of interrupting devices 10 and 10' according to the present invention. Although the two embodiments 10 and 10' function in a similar manner, there are some constructional differences between them. Where similar parts or elements are present in the two devices 10 and 10', the same reference numerals have been used. Both devices 10 and 10' are so-called single-gap devices, but may be constructed with two or more gaps.

The devices 10 and 10' may be used at system voltages of 145 kv or higher and may have an impulse withstand voltage of 650 kv and a low frequency withstand voltage of 310 kv. Both devices 10 and 10' are designed to interrupt at their current interrupting rating within three cycles. The first device 10 may have a fault-interrupting current rating of 10,000 amperes symmetrical, while the device 10' may have a fault-interrupting current rating of 30,000 amperes symmetrical. The continuous current rating of the device 10 is 300 amperes, while the continuous current rating of the device 10' is 600 amperes.

Interrupting Unit 12

Both interrupting devices 10 and 10' include similar interrupting units 12. Each interrupting unit 12 includes an insulative housing 14 made of porcelain, a cycloaliphatic resin, or a similar material having on the exterior surface thereof a plurality of leakage-distance-increasing skirts 16. The housing 14 contains a central bore 18 in which are located the various elements of the interrupting unit 12.

Annular end plates 20 are fixed to each end of the housing 14 as by molding the housing 14 into peripheral grooves 22 therein. The end plates 20 define a central bore 24 communicating and coaxial with the central bore 18. The bore 24 of the upper end plate 20, as viewed in FIGS. 1 and 7, is closed by an end bell 26 attached to the end plate 20 in any convenient manner, such as by bolts or the like. The upper end plate 20 may contain a circular channel 28 which contains an elastomeric O-ring 30 or the like. The O-ring 30 is compressed between the channel 28 and the end bell 26 when the end bell 26 and the end plate 20 are attached. Formed integrally with the end bell 26 is a terminal pad 32 which is connectable by any convenient means to one phase conductor (not shown) of a multiphase high-voltage circuit (not shown).

Depending from the interior of the end bell 26, and extending partially through the central bore 18, is a stationary contact rod or support 34. The stationary contact rod 34 is made of a conductive metal as are the end plate 20, the end bell 26, and the terminal pad 32. Thus, the stationary contact rod 34 is in continuous electrical contact with the terminal pad 32.

The bore 24 of the lower end plate 20 surrounds and is in electrical contact with a sliding contact assembly 36 which extends into the bore 18. The sliding contact assembly 36 comprises a cylindrical member 38 containing a central bore 40 therethrough. The central bore 40 is enlarged into a lower bore 42 and an upper bore 44. A movable contact rod 46 slidingly passes through and is engaged by the walls of the central bore 40. The contact rod 46 also passes through the enlarged bores 42 and 44. The movable contact rod 46 is made of a conductive material and defines a central interior bore 48. At its upper end, the contact rod 46 carries a movable contact assembly 50. The movable contact assembly 50 may take any one of a number of well known configurations, such as a plurality of contact fingers (not shown) biased inwardly by a garter-spring (not shown). The movable contact assembly 50 is shown only in general form as its precise structure is not a part of the present invention.

The movable contact assembly 50 contains an upper central aperture 52 designed to intimately engage the free end 54 of the stationary contact rod 34. This free end 54 functions as a stationary contact for the interrupting unit 12. As shown in FIGS. 1 and 7, when the interrupting unit 12 is closed, the stationary contact 54 enters the aperture 52 in the movable contact assembly 50 for engagement thereby, thus normally completing an electrical circuit between the terminal pad 32 and the movable contact rod 46.

The bore 48 in the movable contact rod 46 may communicate with the aperture 52 in the movable contact assembly 50. Preferably, however, the bore 48 in the movable contact rod 46 terminates in one or more vents 56 formed through either the wall of the movable contact rod 46 or the wall of the contact assembly 50 to permit any fluid moving through such bore 48 to exit from the vents 56. The vents 56 are surrounded by a manifold head 58, the function of which is to direct any fluid exiting from the vents 56 forwardly toward the top of the movable contact assembly 50. Mounted to the movable contact rod 46 and to the manifold head 58 is a nozzle assembly 60 which surrounds the manifold head 58, as well as the movable contact assembly 50. The nozzle assembly 60 includes a main chamber 62 and an outlet chamber 64, the two chambers 62 and 64 being interconnected by a constriction or throat 66.

To ensure continuing electrical continuity between the movable contact assembly 50 and the lower end pate 20 in all positions of the movable contact rod 46, the enlarged bore 44 contains any well known sliding contact structure 68. Thus, in all positions of the contact rod 46, the movable contact assembly 50 is in electrical continuity with the lower end plate 20 via the sliding contact 68 and the assembly 36. Moreover, when the movable contact assembly 50 engages the stationary contact 54, the terminal pad 32 is in electrical continuity with the lower end plate 20.

Attached as by brazing, welding, or the like to the lower free end of the movable contact rod 46 is a collar 70. A robust compression spring 72 is located within the enlarged bore 42 of the sliding contact assembly 36 and acts between the upper surface of the collar 70 and an end wall 74 of the enlarged bore 42.

FIGS. 1 and 7 depict the interrupting unit 12 in the closed position whereat the movable contact assembly 50 and the stationary contact 54 are engaged. As will appear in greater detail below, in this condition of the interrupting unit 12, the collar 70 is held in the position shown to prevent the compression spring 72 from moving the movable contact rod 46 downwardly. Whenever it is desired to interrupt one phase of a circuit to which the device 10 or 10' is connected, the collar 70 is permitted to move downwardly under the action of the compression spring 72. Such downward movement of the collar 70 moves the contact rod 46 downwardly, thus moving the movable contact assembly 50 out of engagement with the stationary contact 54. Such movement of the movable contact assembly 50 opens a gap between the assembly 50 and the stationary contact 54. In this gap there will form a high-voltage arc, one end of which terminates on the movable contact assembly 50 and the other end of which terminates on the stationary contact 54. Continued movement of the movable contact assembly 50 by the compression spring 72 after initial formation of the gap increases the length of the gap and elongates the arc.

As will be set forth in more detail below, prior to the disengagement of the movable contact assembly 50 and the stationary contact 54, a dielectric, arc-extinguishing fluid such as sulfurhexafluoride gas is caused to flow through the bore 48 of the movable contact rod 46. The fluid moves through the bore 48 and exits from the vents 56 where it is directed by the manifold head 58 into the main chamber 62 of the nozzle assembly 60. Thus, as the movable contact assembly 50 and the stationary contact 54 disengage, flowing dielectric fluid is already present in and at the gap opening therebetween. As the gap further opens and the arc is elongated thereby, the fluid flows from the main chamber 62 and past the constriction or throat 66, where it acquires sonic or near sonic velocity, finally exciting from the outlet chamber 64. The fluid exiting the outlet chamber 64 at high speed is directed at the arc formed between the movable contact assembly 50 and the stationary contact 54. The combined action of arc elongation and the cooling and de-ionizing effects of the rapidly flowing fluid ultimately extinguish the arc and interrupt the circuit at a subsequent current zero.

Because the device 10' has a higher continuous current rating than the device 10, various conductive parts of the former, such as the stationary contact rod 34 and the movable contact rod 46 are larger, and can conduct higher current, than their corresponding parts in the device 10. Also, because the device 10' has a higher interrupting rating than the device 10, the bore 48 in the movable contact rod 46 of the device 10' is larger in diameter, and has a greater fluid-carrying capacity than the corresponding bore in the device 10.

First Embodiment 80

Referring now to FIGS. 1–6, there are shown the details of an operating mechanism 80 for the device 10.

The operating mechanism 80 includes a generally rectangular metal housing 82 defining an enclosed chamber 84 in which are located various parts and elements of the operating mechanism 80. The upper end of the chamber 84 contains a circular hole 86. The lower ends of the movable contact rod 46 and the compression spring 72 pass through the hole 86 into the chamber 84 in which the collar 70 is also located. The housing 82 is mounted to the lower end plate 20 by any convenient means, such as brazing, welding, or bolts. The lower end plate 20, similar to the upper end plate 20, contains a circular channel 28 having an O-ring 30 which is compressed between the channel 28 and the upper outside surface of the housing 82.

The lower end of the housing 82 contains a circular hole 88 through which passes a protruding portion 90 of an end bell 92. Integral with the end bell 92 is a terminal pad 94 connectable to a phase conductor (not shown). The upper outside surface of the end bell 92 and the outer side surface of the protruding portion 90 are electrically insulated from the outer surface of the chamber 84 and the side walls of the circular hole 88 by an insulating layer 96. The presence of the insulating layer 96 prevents current in the terminal pad 94 from being conducted to the conductive housing 82 at or near the point of entry of the protruding portion 90 through the circular hole 88. The purpose of so restricting the current flow will appear hereinafter.

The operating mechanism 80 includes four major subassemblies, namely, a lever facility 100, a fluid container assembly 102, a fluid-directing facility 104, and an overcurrent responsive facility 106. The lever facility 100 maintains the movable contact assembly 50 and the stationary contact 54 in their normally engaged position by preventing movement of the movable contact rod 46 through engagement with the collar 70. Further, the lever facility 100, in response to operation of the overcurrent responsive facility 106, permits downward movement of the movable contact rod 46 to disengage the movable contact assembly 50 and the stationary contact 54 for circuit interruption. The overcurrent responsive facility 106 also permits the fluid container assembly 102 to transmit dielectric gas to the bore 48 of the moving contact rod 46 via the gas directing facility 104. The overcurrent responsive facility 106 and the lever facility 100 so cooperate with the fluid container assembly 102 that gas flows from the gas container 102 through the gas directing facility 104 prior to the lever facility 100 permitting movement of the contact rod 46.

Referring to FIG. 1, the lever facility 100 includes a center pivoted lever 110 on a pivot rod 112, which is, in turn, mounted to the interior of the housing 82 or to a structural member therewithin. The lever 110 has a first end 114 which carries a roller 116 thereon. A second end 118 of the lever 110 is engaged and moved by the overcurrent responsive facility 106, as will be described hereinafter. A tension spring 120 is connected between the lever intermediate the pivot rod 112 and the second end 118 and the interior of the housing 82 or a structural member therewithin. The tension spring 120 maintains the lever 110 in the normal position depicted in FIG. 1.

In the normal position of the lever 110, the first end 114 thereof is so configured and the roller 116 on the first end 114 is so located as to be directly in the path of movement of the collar 70. In the normal position of the lever 110, the roller 116 blocks and prevents movement of the collar 70 thereby preventing downward movement of the contact rod 46 and of the movable contact assembly 50 thereon. Thus, in the normal position of the lever 110, the movable contact assembly 50 and the stationary contact 54 cannot disengage.

Referring to FIGS. 1 and 2, the overcurrent responsive facility 106 may be seen to include an open ended insulative tubular member 130 having one end closed by a conductive end cap 132, a circular groove 133 of which supports the member 130 at its right end. The end cap 132 has a flanged rim 134 which is interiorly threaded at 136 to permit threading of the cap 132 onto an exteriorly threaded conductive ring 138 formed integrally with or attached to the housing 82. The tubular member 130 and the ring 138 pass through an aperture 140 formed in the side wall of the housing 82. Threading of the end cap 132 onto the ring 138 mounts the tubular member 130 within the chamber 84 defined by the housing 82.

The tubular member 130 is supported near its left end within the housing 82 by a resilient ring-shaped member 142 (FIG. 3) formed on or integral with a leg 144 of a J-shaped member 146. The J-shaped member 146, the leg 144, and the ring-shaped member 142 are formed of a conductive metal. The main portion 148 of the J-shaped member 146 is mounted as by bolts 150 threaded into tapped holes formed in the protruding portion 90 of the end bell 92. The bolts 150 pass through apertures 152 formed through the main body portion 148. As seen in FIGS. 2 and 3, a portion of the tubular member 130 contains a longitudinal, elongated slot 154 for a purpose to be hereinafter described. The ring-shaped member 142 is opened as at 156 so as to not cover the slot 154.

Contained within the tubular member 130 is a carriage 158 (FIG. 2) which conforms to the interior thereof and is mounted therein for longitudinal sliding. The carriage 158 carries an upstanding finger 160. The finger 160 protrudes through the slot 154 and through the open area 156 in the ring-shaped member 142 and extends beyond the upper limit of both the last-named elements. The finger 160 and the slot 154 are so located that leftward sliding movement of the carriage 158 effects contact between the finger 160 and the second end 118 of the center pivoted lever 110. Continued leftward movement of the carriage 158 and of the finger 160 causes clockwise rotation of the center pivoted lever 110 about the pivot rod 112 to move the first end 114 of the lever 110 out of the path of the collar 70. A helical compression spring 162 acts between the base of the carriage 158 and an insulative layer 164 covering the inside surface of the end cap 132 which electrically insulates the spring 162 from the end cap 132. The compression spring 162 biases the carriage 158 for leftward movement.

The carriage 158 carries a elongated pin 166 at its left end, that is, on the base of the carriage 158. The pin 166 extends beyond the leftward edge of the tubular member 130 carrying on its left end a lance 168 (FIGS. 1 and 5) or other piercing or puncturing member. The pin 166 and the lance 168 move leftwardly with leftward movement of the carriage 158.

Figure 4:
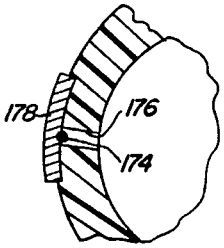

Movement of the carrage 158 by the compression spring 162 is normally prevented by a fusible element 170 and fusible strain wire 172. As is well known, if the fusible element 170, which may be elemental silver, is unable to restrain the force of the spring 162, the strain wire 172 is selected so as to achieve this end. The left ends of the fusible element 170 and the strain wire 172 are connected to the right end of the pin 166. The right ends of the fusible element 170 and the strain wire 172 are connected to the end cap 132. A conductor 174 runs from the point of attachment of the fusible element 170 and strain wire 172 to the pin 166 to and through an aperture 176 formed in the side wall of the tubular member 130. The conductor 174 is connected to a conductive pad 178 which may be molded into, and projects from, the exterior wall of the tubular member 130 as shown in FIG. 4. The conductive pad 178 engages and electrically contacts the interior surface of the ring-shaped member 142. The resilience of the ring-shaped member 142 permits some slight outward deformation as necessary to accommodate the projection of the conductive pad 178.

As a consequence of the last-described structure, the following normal continuous current path is provided: the terminal pad 94, the end bell 92, the protruding portion 90, the J-shaped member 146, the ring-shaped member 142, the conductive pad 178, the conductor 174, the fusible element 170 (and the strain wire 172), the end cap 132, the ring 138, and the housing 82. Because the housing 82 is electrically connected to the movable contact rod 46 via the sliding contact assembly 36, in the normal condition of the device 10, a continuous current path between the terminal pads 32 and 94 is present. The insulative layers 96 and 164 and the insulative tubular member 130 prevent current from being shunted away from this current path. As long as the fusible element 170 and the strain wire 172 remain intact, the carriage 158 is prevented from leftward movement by the compression spring 162 and as a consequence, the pin 166 and the lance 168 also remain stationary.

If an overcurrent flows between the terminal pads 32 and 94, first the fusible element 170 and then the strain wire 172 will fuse, melt or evaporate. Once the strain wire 172 and the fusible element 170 cease to be intact, the compression spring 162 is able to move the carriage 158 leftwardly. Such leftward movement causes leftward movement of the finger 160 and ultimately brings the finger 160 into contact with the second end 118 of the lever 110 for clockwise rotation thereof. In the normal position of the carriage 158, the finger 160 thereof is normally spaced from the second lever end 118 by a distance shown in FIG. 2 and designated by the reference numeral 180. The purpose of this spacing or distance 180 is described below. Clockwise rotation of the lever 110 on the pivot rod 112 against the action of the tension spring 120 moves the first lever end 114 out of the path of the collar 70. At this point, the compression spring 162 moves the collar 70 and the movable contact rod 46 downwardly to disengage the movable contact assembly 50 from the stationary contact 54.

An important feature of the present embodiment involves the replaceability of the tubular member 130. Specifically, the overcurrent responsive facility 106 is a modular element of the device 10, meaning that following the fusing of the fusible element 170 and the strain wire 172 and circuit interruption by the device 10, the current responsive facility 106 may be replaced with a new similar facility 106 following unscrewing of the end cap 132 and removal of the tubular member 130 along with its contained carriage 158, pin 166, lance 168, finger 160, and compression spring 162.

Referring to FIGS. 1 and 5, the fluid container assembly 102 can be seen to include a hermetically sealed fluid-containing cylinder or bottle 190. The cylinder 190 includes a fluid port 192 through which pressurized fluid contained by the cylinder 190 may issue. The part 192 is normally closed by a puncturable or tearable seal 194 which may be a thin metallic diaphragm. Typically, the cylinder 190 is charged with a dielectric gas such as $SF_6$ to a pressure of approximately 45 lbs. per sq. inch.

Connected to the cylinder 190 and surrounding the port 192 and the seal 194 is a tube 196. The tube 196 may contain exterior threads 198 on a portion thereof which may be threaded into matching threads formed on the interior wall of an aperture 200 formed through the housing 82. The aperture 200 is generally aligned with the aperture 140 so that when the cylinder 190 has been attached to the housing 82 by threading the tubular member 196 into the aperture 200, the members 196 and 130 are generally aligned. Much like the overcurrent responsive facility 106, the fluid container assembly 102 forms a modular element of the device 10. When necessary, a new, fully charged cylinder 190 with its integral tube 196 and the port 192 and seal 194 may be attached to the housing 82 following removal of the previous assembly 102.

The length of the pin 166 and the length of the lance 168 are so adjusted that, with both the assembly 102 and the overcurrent responsive facility 106 in place, the lance 168 is spaced slightly from the seal 194 as indicated at 202 by a distance which is less than the space 180 between the second lever end 118 and the finger 160. In order to puncture, rupture or tear the seal 194, the lance 168 may include a sharp cutting tip 204.

Leftward movement of the carriage 158 resulting from an overcurrent through the device 10 brings the cutting tip 204 of the lance 168 into contact with the seal 194. Further leftward movement of the lance 168 causes this cutting tip 204 to tear, puncture or rip the seal 194, permitting the pressurized dielectric fluid contained within the cylinder 190 to escape therefrom. Because of the difference in the spacings 202 and 180, piercing of the seal 194 and fluid flow from the cylinder 190 occur prior to disengagement of the movable contact assembly 50 from the stationary contact 54.

Referring to FIGS. 1, 2, 5 and 6, the fluid-directing facility 104 includes a T-shaped manifold 210 having a first arm 212, a second arm 214, and a leg 216. The arms 212 and 214 and the leg 216 are hollow and form a continuous passageway. The inside diameters of the arms 212 and 214 are slightly larger than the outside diameter of the tubular members 130 and 196 when the overcurrent responsive facility 106 and the fluid container assembly 102 are mounted to the housing 82. As a consequence, mounting of the overcurrent responsive facility 106 and the fluid container assembly 102 to the housing 82 causes the tubular members 130 and 196 to enter the arms 212 and 214. Appropriate sealing facilities (not shown) may ensure that the connections of the arms 212 and 214 with the tubular members 130 and 196 does not permit the leakage of fluid. Fluid cannot flow through the tubular member 130 because of the conformal engagement of the carriage therewith.

The leg 216 of the manifold 210, the interior of which communicates with the interior of arms 212 and 214, extends upwardly and is telescoped into the bore 48 in the movable contact rod 46. This telescoping serves two functions. First, the leg 216 serves as a guide for the movable contact rod 46 as it moves downwardly to disengage the movable contact assembly 50 from the stationary contact 54. Additionally, any fluid flowing in the arm 212 and thence to the leg 216 is communicated to such bore 48 in the movable contact rod 46; this fluid ultimately issues from the nozzle assembly 60. The T-shaped manifold 210 may be mounted by appropriate facilities (not shown) to the interior of the housing 82 or to a structural member therewithin.

The above-described leftward movement of the carriage 158 following an overcurrent through the device 10 first causes the seal 194 to be punctured by the lance 168. The puncturing of the seal 194 causes the pressurized fluid to flow from the cylinder 190 through the first arm 212 and then through the T-shaped manifold 210. Fluid from the T-shaped manifold 210 flows through the bore 48 in the movable contact rod 46, and from there, out of the vents 56 into the main chamber 62 of the nozzle assembly 60. A short time after fluid flow begins, and due to the difference in the spacings 180 and 202, the finger 160 pivots the lever 110 so that the first end 114 thereof moves out of the path of the collar 70. Accordingly, some time after fluid flow has begun, the compression spring 72 is able to move the movable contact rod 46 downwardly, thus disengaging the movable contact assembly 50 from the stationary contact 54. The cylinder 190 is sufficiently charged with dielectric fluid so that the arc formed between the movable contact assembly 50 and the stationary contact 54 is subjected to a sufficient quantity of cooling and de-ionizing dielectric fluid that, in combination with the arc's elongation, causes the arc to be extinguished at a subsequent current zero. Movement of the movable contact rod 46 continues until the collar 70 engages one or more bumpers 218 (FIG. 1) mounted to the housing 82. By the time the collar 70 engages the hampers 218, the circuit has been interrupted by the device 10. The device 10 may be used subsequently, following the above-described replacement of the fluid container assembly 102 and the overcurrent responsive facility 106 of the device 10 by manual re-engagement of the movable contact assembly 50 with the stationary contact 54.

Reclosing of the device 10 is preferably effected by means of a pair of reset arms 220 pivotal on a shaft 222 which is journaled for rotation in the housing 82. The reset arms 220 straddle the leg 216 of the manifold 210 and are engageable with the underside of the collar 70 at diametrically opposed points. The normal position of the reset arms 220 is that shown in FIG. 1 which position is maintained by a spring 224 connected between one of the reset arms 220 and the housing 82. The shaft 222 is rotated by rotation of a reset lever 226 attached to the shaft 222 on the exterior of the housing 82. The reset lever 226 includes a switch stick-engageable ring 228. Engagement of the ring 228 by a switch stick (not shown) and counterclockwise rotation of the pull down lever 226 rotates the reset arms 220 counterclockwise. Counterclockwise rotation of the reset arms 220 first causes engagement between such arms 220 and the collar 70 which rests against the bumpers. Further counterclockwise rotation of the reset arms 220 results in upward movement of the collar 70 past the roller 116 and the first lever end 114, the tension spring 120 ultimatelycausing the first lever arm 114 to fall back into place in the path of the collar 70.

Second Embodiment 240

Referring now to FIGS. 5, 6, 7 and 8, the device 10' in accordance with a second embodiment of the present invention is shown. An operating mechanism 240 of the device 10' contains many elements which are similar to or the same as those previously described and the same reference numerals have been used to indicate these.

The operating mechanism 240 includes a housing 242 which is similar to the housing 82, but is elongated in the vertical direction. The upper end of the housing 242 is attached to the insulative housing 14 of the device 10' in the same manner as the housing 82 of the device 10. Similarly, the movable contact rod 46, the collar 70, and the compression spring 72 extend into a chamber 244 defined by the housing 242. At the lower end of the housing 242, there is mounted the end bell 92 having the protruding portion 90 in exactly the same manner as was the case with the device 10. Furthermore, the device 10' includes the same type of reset arms 220 and reset lever 226 as are present in the device 10.

The device 10' includes a lever facility 100, a fluid container assembly 102 and a fluid-directing facility 104, all of which are the same as in the mechanism 80, and an overcurrent responsive facility 250 which varies from the overcurrent responsive facility 106 used in the mechanism 80.

The overcurrent responsive facility 250 of the device 10' includes a tubular member 252 similar to the tubular member 130, but which need not be replaceable as will be seen hereinafter. The tubular member 252 is telescoped into the second arm 214 of the T-shaped manifold 210. The tubular member 252 contains a conformal movable carriage 254 mounted for limited leftward sliding movement within the member 252 under the influence of a compression spring 256. The carriage 254 carries opposed fingers 258 and 260 which extend outside of the tubular member 252 and slide in a pair of diametrically opposed slots 262 and 264 formed in the tubular member 252. The finger 258 serves a function similar to that served by the finger 160 of the mechanism 80. The finger 258 is spaced by the same distance 180 from the second lever end 118 as was the case in the mechanism 80.

The movable carriage 254 carries the pin 166 with the lance 168 at the end thereof which are the same as in the device 10. Moreover, the lance 168 performs the same function as in the device 10 and is spaced by a distance 202 from the seal 194, the distance 202 being less than the distance 180 between the finger 258 and the second lever end 118.

The finger 260 on the movable carriage 254 is normally engaged by a first end 266 of a pivotal L-shaped lever 268 which normally prevents movement of the finger 260 and of the movable carriage 254. The lever 268 has a second end 270 which is held in its normal position, as shown in FIG. 7, by a flux gate latch release mechanism 272. The flux gate latch release mechanism 272 and the second lever end 270 are interconnected by a push rod 274 pivotally connected to the second lever end 270. A tension spring 276 is connected between the second lever end 270 and the housing 242 or a structural member therein. The tension spring 276 attempts to rotate the second lever end 270 clockwise to rotate the first end 266 clockwise out of the path of the finger 260. The flux gate latch release mechanism 272 prevents such rotation, however, until it receives an appropriate signal from a processing unit 278. The processing unit 278, in turn, receives the output of a current transformer 280 physically mounted in any convenient way to the interior of the housing 242. The current transformer 280 surrounds and receives its input from a metal loop 282 which is connected at one point to the protruding portion 90 of the end bell 92 and at its other end to the housing 242. Because the end bell 92 and the protruding portion 90 are insulated from the housing 242 by the insulative layer 96, current flowing from the terminal pad 94 through the end bell 92 and the protruding portion 90 is forced through the loop 282 to provide an input to the current transformer 280.

Thus, a normal continuous current path through the device 10' is provided as follows: the terminal pad 94, the end bell 92, the protruding portion 90, the loop 282, the housing 242, the sliding contact assembly 36, the movable contact rod 46, the movable contact assembly 50, the stationary contact 54, the stationary contact rod 34, the end bell 26, and the terminal pad 32. This current path remains as long as the current in the circuit protected by the device 10' does not exceed a predetermined overcurrent level as determined by the processing unit 278 which receives signals from the current transformer 280 proportional to the current and for the rate of change thereof flowing through the device 10'. When the processing unit 278 detects an overcurrent in the circuit, an appropriate signal is transmitted to the latch release mechanism 272 which moves the push rod 274 leftwardly in aid of the normal bias of the tension spring 276 to rotate the second lever ends 266 and 270 clockwise. Clockwise rotation of the first lever end 266 permits the compression spring 256 to move the carriage 254 leftwardly. Such leftward movement of the carriage 254 first causes the lance 168 to pierce, puncture, or tear the seal 194 on the cylinder 190. As a consequence, the pressurized dielectric fluid within the cylinder 190 flows from the port 192 thereof and through the tubular member 196. Shortly thereafter, the finger 258 on the carriage 254 engages the second lever end 118 to rotate the second lever 110 clockwise. Such clockwise rotation of the second lever 110 rotates its first end 114 out of the path of the collar 70 permitting the compression spring 72 to move the movable contact rod 46 downwardly, thus disengaging the movable contact assembly 50 from the stationary contact 54.

Fluid flow from the tubular member 196 to the leg 216 of the T-shaped manifold 210 is exactly the same as in the device 10.

Conclusion

While there have been described two preferred embodiments 10 and 10' of the present invention, it will be clear to those skilled in the art that various changes and modifications of the described structure can be made without departing from the scope of this invention. Clearly, various modifications can be made to the various parts and elements of the interrupting unit 12 and to various other parts and elements of the devices 10 and 10'. The important features of the devices 10 and 10' include their bus-mountability, their simplicity, their manual resettability, and the four major components—the lever facility 100, the replaceable fluid container assembly 102, the fluid-directing facility 104, and the overcurrent responsive facility 106 (replaceable) or 250—utilized in the respective operating mechanisms 80 or 240 which initiate fluid flow prior to disengagement of the movable contact assembly 50 from the stationary contact 54.

We claim:

1. An improved circuit interrupting device of the type having an insulative housing surrounding a pair of normally engaged contacts, which contacts are disengageable to open a gap therebetween, and means for biasing the contacts toward disengagement; a dielectric fluid directed at an elongating arc formed in the gap being effective to extinguish the arc; wherein the improvement comprises:

two-position lever means having a first normal position for maintaining the contacts engaged against the action of the biasing means and a second position for permitting disengagement of the contacts by the biasing means;

a replaceable container of pressurized dielectric fluid having a port through which the fluid issues;

puncturable seal means on the container for normally closing the port;

means for directing fluid from the port to the gap; and means responsive to an overcurrent through the circuit and the device for first puncturing the seal means and then moving the lever means to the second position.

2. A device as in claim 1, wherein:

the puncturing and moving means comprises a carriage movable between a first and a second location;

means for normally holding the carriage in the first location and for moving the carriage to the second location in response to an overcurrent through the device;

lance means carried by the carriage for puncturing the seal means after a predetermined amount of movement of the carriage out of its first location toward its second location; and a finger on the carriage for moving the lever means from its first to its second position following movement of the carriage in excess of the predetermined amount.

3. A device as in claim 2, wherein the lever means comprises a center-pivoted, two position lever, a first end of which blocks disengagement of the contacts in the first position of the lever and permits disengagement of the contacts in the second position of the lever, a second end of the lever being engaged by the finger during carriage movement from the first toward the second location to move the first end of the lever from the first to the second position; and a spring for biasing the lever toward its first position.

4. A device as in claim 3, wherein:

movement of the carriage toward the second location is generally toward the container and the seal means in a first direction;

the lever pivots on an axis generally normal to the first direction; and disengagement of the contacts is along a line generally normal to both the first direction and the axis.

5. A device as in claim 3, wherein at least one of the contacts is movable and which further comprises a movable rod for mounting the one contact; and a collar on the rod, the collar being held against movement by the first end of the lever when the lever is in the first position to maintain the contacts in engagement, the collar being free to move when the lever is in the second position to permit the contacts to disengage and wherein the biasing means comprises a drive spring acting against the collar.

6. A device as in claim 5, wherein the other contact is connected to a first circuit-connectable terminal on the insulative housing, and which further comprises a conductive housing mounted to the insulative housing and carrying a second circuit-connectable terminal, the conductive housing having means thereon for selectively mounting the replaceable container thereto and enclosing the lever means, the gas-directing means, and the overcurrent responsive means; and means for continuously electrically connecting the conductive housing to the movable rod.

7. A device as in claim 6, wherein the fluid directing means comprises a first tubular member carried by the container and surrounding the seal means and the port, the first tubular member protruding into the conductive housing when the container is mounted thereto;

a second tubular member in the conductive housing forming a continuous passage with the first tubular member, the second tubular member at least partially enclosing the carriage, the lance means being positioned at least partially within one of the tubular members when the first and second tubular members form the continuous passage; and a third tubular member communicating with the continuous passage formed by the first and second tubular members.

8. A device as in claim 7, wherein the second tubular member is removably insertable into the conductive housing and at least partially encloses the current responsive means.

9. A device as in claim 8, wherein the container and the first and second tubular members are replaceable following interruption of the circuit by the device, the seal means, the overcurrent responsive means, the carriage, and the lance means being also replaceable as a consequence thereof.

10. A device as in claim 7, wherein the container and the first tubular member are replaceable following interruption of the circuit by the device, the seal means being also replaceable as a consequence thereof.

11. The device of claim 9 or 10, wherein the third tubular member comprises a T-shaped tube having opposed arms, one of which is attachable to the first tubular member, the other of which is attachable to the second tubular member, and a leg connected to both arms, the leg being telescoped with the rod to guide movement thereof, the drive spring coaxially surrounding the leg and the rod.

12. The device of claim 11, wherein the rod is hollow, and wherein the fluid-directing means further comprises a manifold communicating with the interior of the hollow rod; and a nozzle for directing gas flowing from the manifold at the gap, fluid issuing from the port flowing through the first tubular member, the T-shaped tube, the hollow rod, the manifold, and the nozzle.

13. A device as in claim 2, 3, 4, 5, 6, 7, 8 or 9, wherein the carriage holding and moving means comprises a fusible element normally connected between the carriage and a fixed point for preventing carriage movement, the fusible element carrying current in the device and ceasing to be intact upon the occurrence of an overcurrent.

14. A device as in claim 13, wherein the carriage holding and moving means further comprises a spring for biasing the carriage out of the first location and toward the second location.

15. A device as in claim 2, 3, 4, 5, 6, 7 or 10, wherein the carriage holding and moving means comprises a current transformer which produces an output proportional to the current in the device, and latch means for normally preventing carriage movement and for permitting carriage movement in response to an output of the current transformer indicative of an overcurrent in the device.

16. A device as in claim 15, wherein the carriage holding and moving means further comprises a spring for biasing the carriage out of the first location and toward the second location.

17. A circuit interrupting device comprising:

(a) first and second contacts continuously connected to the respective sides of the circuit, the contacts being relatively movable into and out of engagement;

(b) means for continuously biasing the contacts out of engagement;

(c) means for selectively maintaining the contacts in engagement against the action of the biasing means;

(d) a selectively removable reservoir of pressurized dielectric fluid, the reservoir having a port through which the fluid issues at high velocity;

(e) pierceable means for normally sealing the fluid port;

(f) means for directing fluid issuing from the port at the contacts; and (g) means responsive to an overcurrent in the circuit for first piercing the sealing means and then disabling the maintaining means so that the contacts move out of engagement in the presence of an already initiated high velocity flow of the fluid to extinguish any arc formed between the contacts.

18. A device as in claim 17, wherein:

the directing means comprises conduit means connected at one end to the port; and means for mounting the second contact to the other end of the conduit means.

19. A device as in claim 18, wherein the conduit means comprises a first stationary conduit selectively attachable to the reservoir and surrounding the port at a first end thereof, the first conduit having a second end; and a second movable conduit, a first end of which is telescoped with the second end of the first conduit for relative sliding movement of the conduits, a second end of the second conduit mounting the second contact, relative sliding movement of the conduits resulting in relative movement of the contacts.

20. A device as in claim 19, wherein the biasing means comprises a collar on the second conduit; and a spring acting between the collar and a fixed point.

21. A device as in claim 20, wherein the spring is a compression spring coaxial with the second conduit and acting on a first side of the collar facing the contacts; and the maintaining means includes a centrally pivotable lever, one end of which normally bears against a second side of the collar facing away from the contacts, the other end of which is moved by the disabling means in response to the overcurrent to move the one lever end away from the collar to permit the spring to disengage the contacts.

* * * * *